US006491542B1

(12) United States Patent
Zerebilov

(10) Patent No.: US 6,491,542 B1
(45) Date of Patent: Dec. 10, 2002

(54) COMBINED CONNECTION AND TERMINAL POSITION ASSURANCE STRUCTURE FOR VEHICLE WIRING CONNECTORS

(75) Inventor: Arkady Y. Zerebilov, Manheim, PA (US)

(73) Assignee: Yazaki North America

( * ) Notice: Subject to any disclaimer, the term of this patent is extended or adjusted under 35 U.S.C. 154(b) by 0 days.

(21) Appl. No.: 10/050,364

(22) Filed: Jan. 16, 2002

(51) Int. Cl.[7] ..... H01R 13/62

(52) U.S. Cl. ..... 439/489; 439/595; 439/352; 439/752

(58) Field of Search ..... 439/489, 752, 439/595, 352, 353, 357, 358

(56) References Cited

U.S. PATENT DOCUMENTS

| | | | | |
|---|---|---|---|---|
| 4,984,998 A | | 1/1991 | Duncan et al. | |
| 5,192,225 A | * | 3/1993 | Suzuki | 439/350 |
| 5,641,300 A | | 6/1997 | Corrion | |
| 5,647,777 A | | 7/1997 | Sasai et al. | |
| 5,860,822 A | * | 1/1999 | Nishide et al. | 439/206 |
| 5,928,038 A | * | 7/1999 | Berg et al. | 439/489 |
| 6,261,115 B1 | * | 7/2001 | Pederson et al. | 439/352 |
| 6,261,116 B1 | | 7/2001 | Ceru | |
| 6,368,164 B1 | * | 4/2002 | Nakamura | 439/489 |

* cited by examiner

*Primary Examiner*—Tho D. Ta
(74) *Attorney, Agent, or Firm*—Young & Basile

(57) ABSTRACT

A TPA (terminal position assurance) and CPA (connector position assurance) combining structure for a connector in a vehicle wiring system connector set. The TPA/CPA combining structure is a CTPA (connector/terminal position assurance) member movably mounted on a specially formed connector latch on the first connector's housing between TPA preset, TPA set/CPA preset, and CPA set positions. The CTPA member responds to a complete terminal installation in the first connector housing by becoming movable from TPA preset to TPA set, externally verifying terminal installation and securing a terminal latching member on the housing from unintended release. The TPA set position is also a CPA preset position in which the TPA-assured first connector is ready to receive a mating connector, a portion of which releases the CTPA member from CPA preset to allow movement to a final CPA set condition verifying full connector mating.

8 Claims, 7 Drawing Sheets

COMBINED CONNECTION AND TERMINAL POSITION ASSURANCE STRUCTURE FOR VEHICLE WIRING CONNECTORS

FIELD OF THE INVENTION

The present invention is in the field of connectors of the type used in vehicle wiring systems, and more particularly in the field of the locking structures used to secure mated male and female connector housings and their terminals.

BACKGROUND OF THE INVENTION

Male and female connections in vehicle wiring systems need to be robust and resistant to disconnection. Connector housings are therefore often provided with locking structure engaged as the connectors are joined to keep the housings and their mated terminals locked together. A common form of lock structure uses a flexible lock arm on one of the connector housings and a mating receptacle or latch on the other of the connector housings. The lock structure is often manually releasable so that mated connectors can be intentionally separated for terminal maintenance, repair, or replacement.

Improperly mated terminals inside the connector housings may not be readily apparent, but can create significant problems for the installer and end user if undiagnosed at the time of installation. The preferred and most direct approach to ensuring properly mated connector terminals uses "terminal position assurance" (TPA) structure on mating connector housings to give the installer an external indication of fully inserted terminals at the time the terminals are installed in their respective housings, thereby ensuring fully mated terminals once the connectors are joined. TPA structure is often designed to hinder or block unintended withdrawal of the terminals as well.

It has also become popular to use "connection position assurance" (CPA) devices on mating connectors to indicate proper connection of the connector housings and, indirectly, of their previously inserted and TPA-assured interior terminals. Such CPA devices sometimes additionally protect the housing lock structure against accidental release.

Both TPA and CPA devices can be applied to a connector set. However, the multiple pieces and interlocking structures can be complicated to manufacture and coordinate on the relatively small confines of the typical automotive connector set. The use of both CPA and TPA structure on a single connector set also increases the number of molds which must be manufactured and maintained, increases the need for inventory management of the parts involved, and requires more assembly. Accordingly, the desirable CPA feature is often considered optional by customers and may be omitted for convenience and cost.

SUMMARY OF THE INVENTION

The present invention is a combined CPA/TPA (hereafter "CTPA") structure in which one of the mating terminal-containing connector housings is provided with a unified, movably-mounted CTPA member. The CTPA member cooperates with the connectors and their terminals at various stages of terminal installation, connector mating, and terminal mating to ensure both TPA and CPA protection.

The CTPA member initially rests on its connector housing in a TPA preset position that allows a terminal to be installed therein. A properly inserted terminal allows the CTPA member to be subsequently moved to a TPA set position in which the installer is given visual, tactile, external confirmation that the terminal is fully seated and in which the terminal is protected from accidental withdrawal. An improperly installed terminal prevents the CTPA member from being moved to the TPA set position, giving the installer a visual, tactile, external warning that the terminal inside is not properly installed.

The TPA set position is simultaneously a CPA preset position in which a mating connector is ready to be received to mate its terminal(s) with the TPA-assured terminal(s) of the first connector.

Until the CTPA member on the first connector is in the CPA preset position, the installer has a visible indication in relation to the connector body that connector mating would be premature. The CTPA member may also be configured to block the mating connector until the CTPA member has been moved to the TPA set/CPA preset position on the first connector.

As the mating connector is joined with the first connector while the CTPA member is in the CPA preset position, a portion of the mating connector releases the CTPA member from the CPA preset position, allowing the CTPA member to be moved to a final, CPA set position. In the CPA set position the mating connector is locked to the first connector and the CTPA member is locked in the CPA set position. In a particular embodiment the first connector includes a manual release for the mating connector, and the CTPA member in the CPA set position protects the manual release against unintentional operation.

In a further embodiment the first connector has a cantilever connector latch, and the CTPA member has a cantilever locking arm which rides on the cantilever connector latch between the TPA preset, TPA set/CPA preset, and CPA set positions. The cantilever connector latch and CTPA locking arm flex as a unit, except in transition between the various preset and set conditions. During these transitions, the CTPA locking arm is released to allow the CTPA member to shift on the first connector to a different position. The cantilever connector latch is adapted to receive and lock a portion of the mating connector, which portion simultaneously releases the CTPA locking arm from its TPA set/CPA preset position on the cantilever connector latch. The cantilever connector latch also includes the earlier mentioned manual release, which is protected by the CTPA member in the final, CPA set position to prevent unintentional release of the first connector.

The invention is applicable to both single and multiple terminal connections, and to different types of terminal connectors such as used in vehicle electrical, optical, optoelectronic, RF, and other known types of connection. The invention is adaptable to virtually any style of plug-together connection in which a first connector housing receives a terminal prior to receiving a mating connector, regardless of the type of power or signal transmission effected by the terminals themselves.

These and other features and advantages of the present invention will become apparent upon further reading of the specification, in light of the accompanying drawings.

DETAILED DESCRIPTION OF THE ILLUSTRATED EMBODIMENTS

Figure 1:
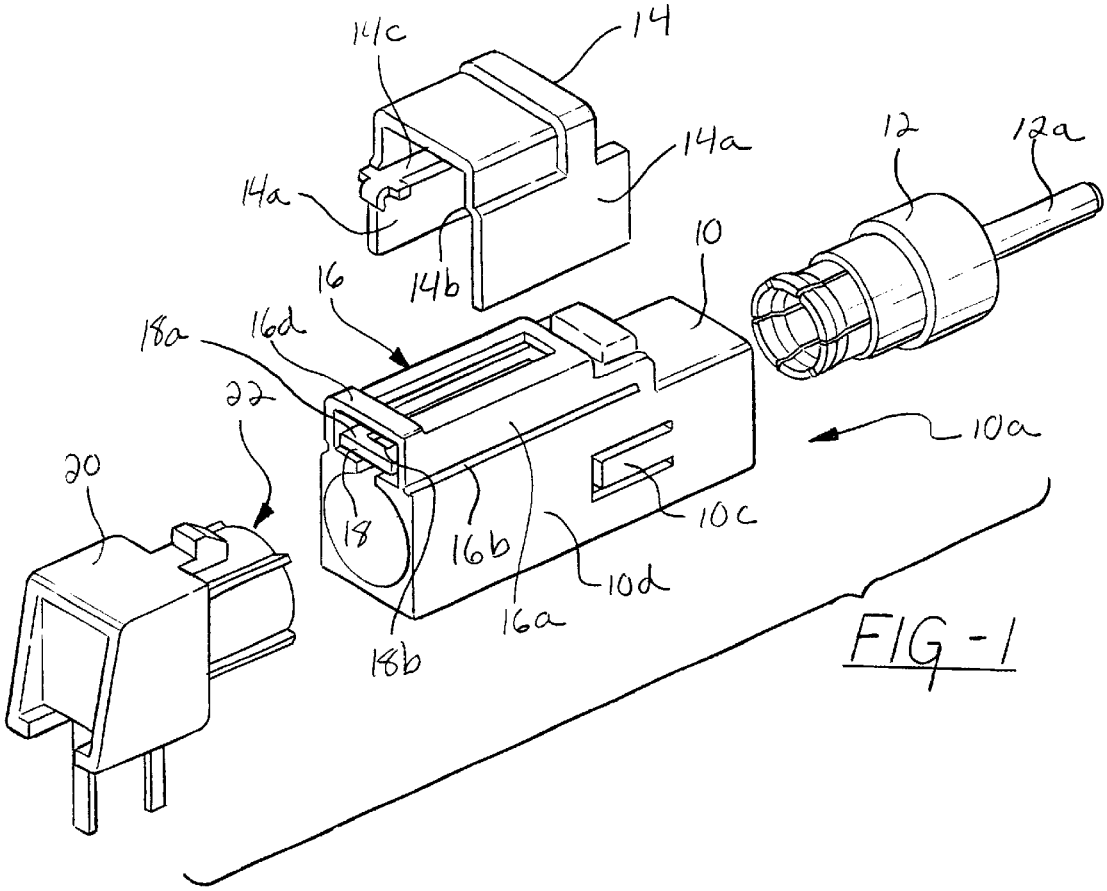
FIG. 1 is an exploded, perspective view of a male/female connector set provided with an exemplary CTPA locking structure according to the invention.

Referring first to FIG. 1, the present invention is illustrated in the context of a male/female shielded electrical connection of a type commonly used in vehicle wiring systems. While the illustrated connection is a shielded, coaxial, pin-and-barrel style, it will be understood by those skilled in the art of vehicle wiring systems that the invention is applicable to many styles of male/female or other plug-together connector set using different types of terminals. Blade/blade and pin-and-barrel type electrical terminal connections are probably the most common type of connection in the vehicle wiring art, but optical, optoelectronic, RF, and both shielded and unshielded terminal connections are used and can be enhanced with the present invention.

Figure 6:
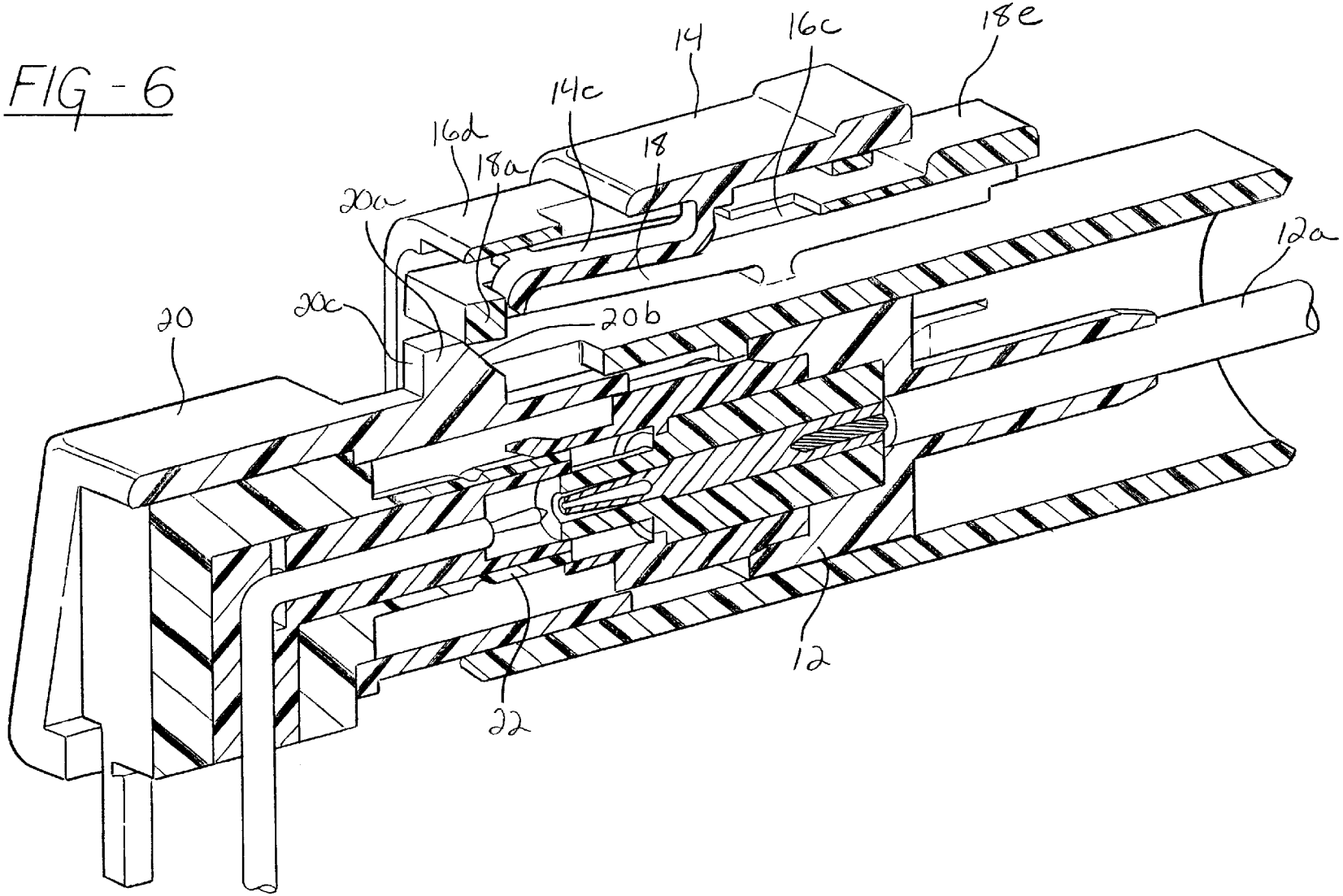
FIG. 6 is a cutaway perspective view similar to FIG. 5, but with the second, mating connector inserted partway into the first connector housing.

FIG. 1 shows the main components of a typical vehicle electrical connection: first connector housing 10 adapted to receive and hold a first terminal 12, and a mating connector housing 20 adapted to receive and hold a mating terminal 22 (inside, better shown in FIG. 6). In the illustrated embodiment, connector housing 10 and terminal 12 are both female, and connector housing 20 and terminal 22 are both male. The male and female nature of the connector housings and their terminals can be mixed and matched in different combinations, as is well known in the art, and the invention is not limited to the example shown here. The connector components are formed primarily from non-conductive polymer materials such as but not limited to nylons, resins, and polyethylenes, except for portions of the terminals whose interiors will typically include conductive metal connections, shielding, phototransceivers, and wire, optic fiber, or cable portions depending on the type of terminal.

In accord with the invention, first connector housing 10 is adapted to receive and movably mount a CTPA member 14 on a specially-formed connector locking structure 16. In the illustrated embodiment, connector locking structure 16 is an integrally formed portion of the polymer connector housing 10, created for example during a molding process. Structure 16 is an exterior element of the connector housing, meaning that the CTPA member 14 is visible and manually operable once mounted on the connector housing. Partially shrouding or enclosing structure 16 and CTPA member 14 is possible if it still permits visibility and operability as described below. CTPA member 14 is also preferably formed from a non-conductive polymer, for example by a known molding process.

Figure 2:
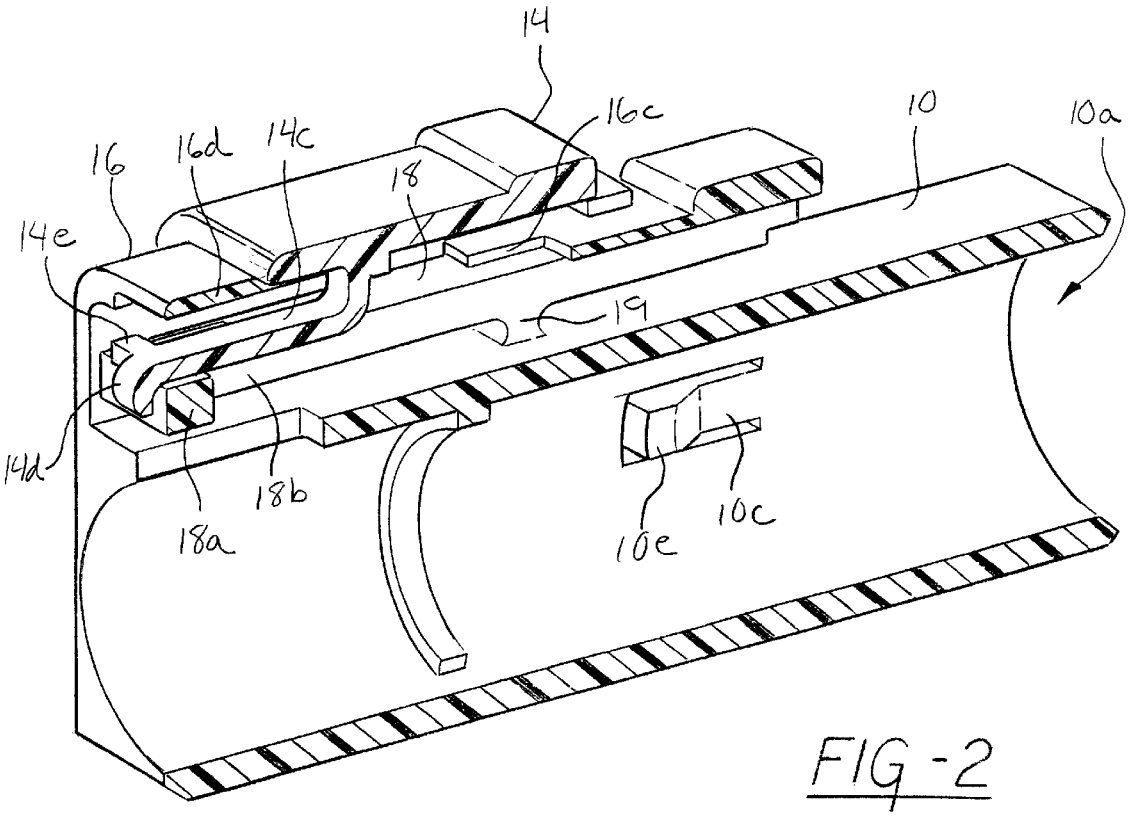
FIG. 2 is a cutaway perspective view of the CTPA-supporting connector housing of FIG. 1, with the CTPA member installed in a TPA preset position.

FIG. 2 illustrates CTPA member 14 installed on connector 10 by slide- or snap-fitting it onto structure 16 in the forward, TPA preset position shown. CTPA member 14 has a generally U-shaped cross-section whose sidewalls 14*a* fit closely over the sidewalls 16*a* of connector locking structure 16 and sidewalls 10*d* of connector housing 10 and slide forward and rearward thereon, guided for example by rails 14*b* riding in grooves 16*b*. Structure 16 has a longitudinal upper slot 16*c* extending rearwardly from a bridge portion 16*d* at its front end, which slot is wide enough to accept a lock arm 14*c* extending from the underside of CTPA 14.

Structure 16 contains a cantilever latch arm 18 mounted at a rearward support 19 to the connector housing, and aligned with slot 16*c*. Cantilever latch arm 18 is designed to support and mate with CTPA lock arm 14*c* in several different positions, thereby defining TPA preset, TPA set/CPA preset, and CPA set positions which give a person assembling the connector set an external indication of the mating condition of the terminals and connector housings at different stages of assembly.

In the TPA preset condition of FIG. 2, CTPA lock arm 14*c* rests on the forwardmost end 18*a* of latch arm 18, with a hook or tab 14*d* extending in front of and below end 18*a* to hinder rearward (to the right) movement of the CTPA member on the connector housing. In the illustrated embodiment, CTPA lock arm 14*c* includes sideways projecting ears 14*e* which rest on the upper surface of the latch arm. CTPA lock arm 14*c* and hook 14*d* are aligned with a central longitudinal slot 18*b* extending rearwardly on the latch arm to a point short of the cantilever beam support 19.

Figure 3:
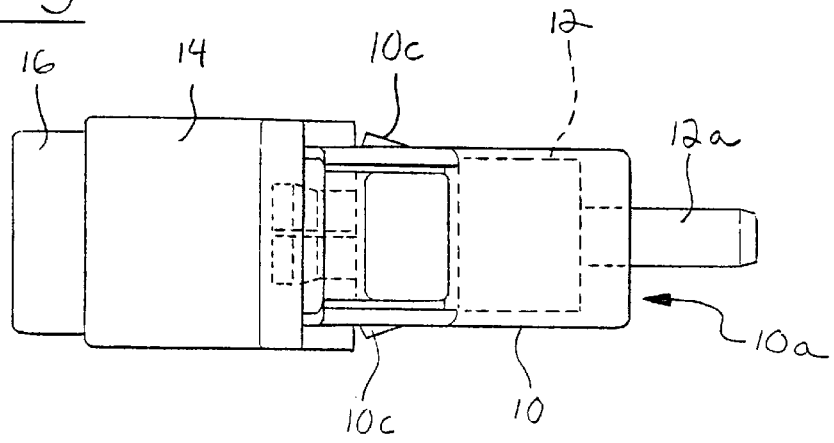
FIG. 3 is a plan view of the connector housing and CTPA of FIG. 2, with the addition of the terminal for the connector housing inserted partway into the housing.

The TPA preset condition of FIG. 2 places the CTPA member 14 forward of terminal locking structure formed on connector housing 10, in the illustrated embodiment a pair of flexible latches 10*c* located on the sidewalls 10*d* of connector housing 10. Terminal locking latches 10*c* are flexible, cantilevered cutout portions of the connector housing sidewalls, essentially flush with the exterior of sidewalls 10, but having interior faces with raised camming portions 10*e* extending into the interior of the connector housing in the insertion path of terminal 12. FIG. 3 shows terminal 12 inserted partway into housing 10 from end 10*a*, sufficient to engage but not clear terminal latches 10*c*. This represents an improper installation of terminal 12, one in which neither the mating position nor the security of the terminal in the housing is assured. Terminal latches 10*c* are cammed outwardly from the connector sidewalls as the terminal displaces the interior cam surfaces 10*e*, blocking CTPA member 14 against any rearward movement from the TPA preset position. A person subsequently assembling the connector set would know immediately from the position of CTPA member 14 that the terminal in housing 10 was improperly inserted.

CTPA member 14 can be moved rearwardly prior to any insertion of terminal 12 once the frictional engagement of hook 14*d* and forward end 18*a* of the connector latch arm is overcome, but the assembler would know from the lack of a terminal wire or cable such as 12*a* extending from the terminal insertion end 10*a* of housing 10 that connector mating would be premature.

In addition to the external indication given by the CTPA member's position on housing 10 in the TPA preset condition, the presence of hook 14*d* forward of and below latch arm end 18*a,* and the presence of CTPA lock arm 14*c* between cantilever latch arm 18 and the underside of the forward end of structure 16 might prevent or at least hinder insertion of a mating connector into housing 10, especially if the dimensions of these parts were sized to do so.

Figure 4:
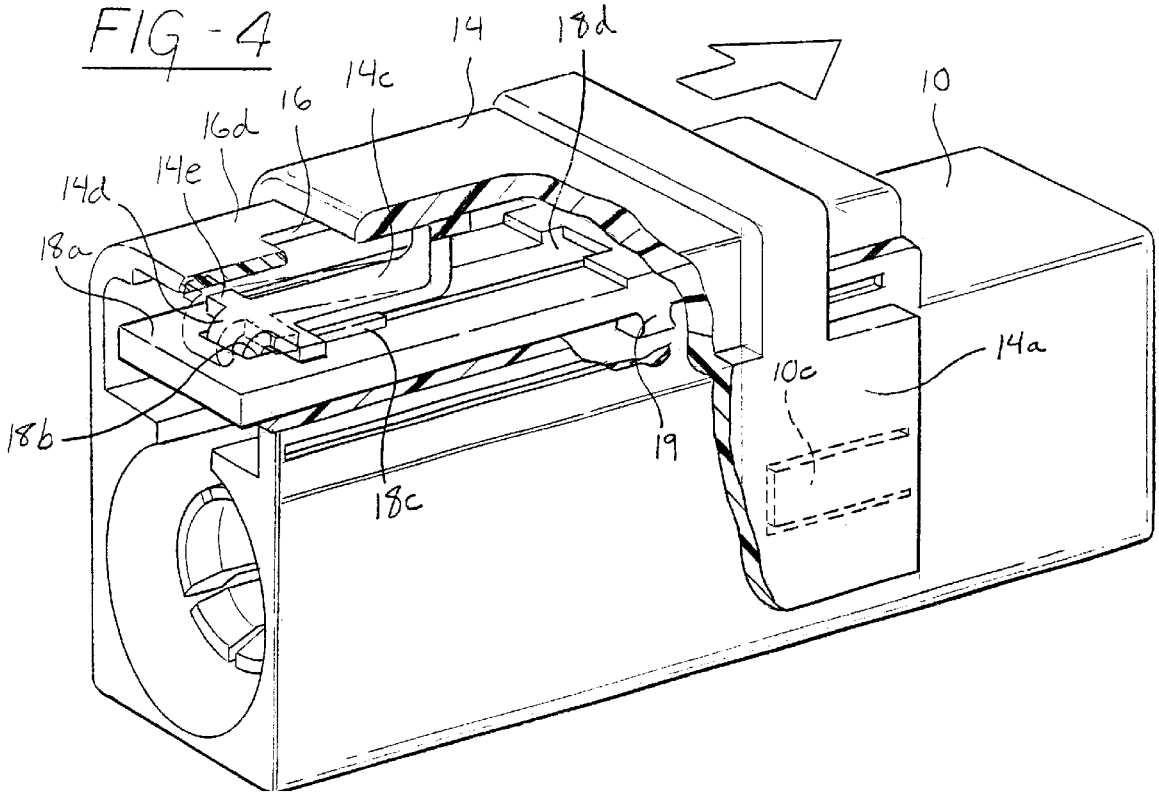
FIG. 4 is a partially cut away perspective view of the CTPA-supporting connector housing, with the terminal fully inserted in the connector housing and the CTPA member shown in transition between TPA preset and TPA set positions (phantom lines) and in the TPA set position (solid lines)

Referring next to FIG. 4, terminal 12 has been fully inserted into housing 10, clearing the camming portions 10*e* of latches 10*c* so that the latches return to their rest position essentially flush with the exterior sidewalls of housing 10. This proper, full installation of terminal 12 allows CTPA member 14 to be slid rearwardly to a TPA set position by overcoming the interference between hook 14*d* and the front end 18*a* of latch arm 18. In FIG. 4, the CTPA member is shown both in transition between the TPA preset and TPA set positions (phantom lines), with CTPA lock arm 14*c* flexed upward to slide back over latch arm forward end 18*a;* and in the TPA set position (solid lines).

Figure 5:
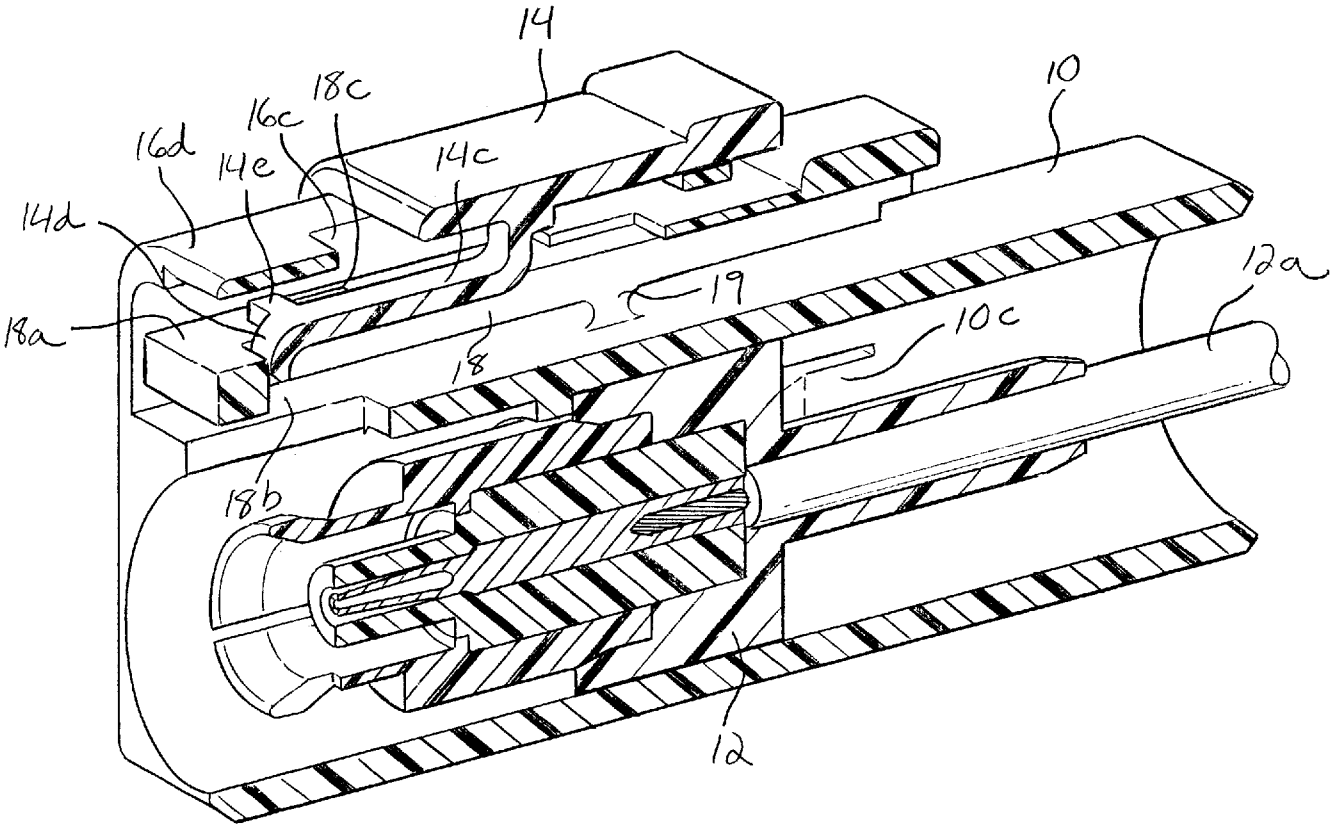
FIG. 5 is a fully cutaway perspective view similar to FIG. 4, with the CTPA member in the TPA set/CPA preset position.

Referring next to FIG. 5, CTPA member 14 is in the TPA set position, with hook 14*d* having dropped into a forward portion 18*b* of the slot in latch arm 18, in front of structural ears 18*c* defining the transition from TPA set to CPA set. In the illustrated embodiment, TPA set slot portion 18*b* is part of a continuous slot which also includes a CPA set portion 18*d* behind ears 18*c*. It is also possible to interrupt the slot with transition-defining structure between portions 18*b* and 18*d,* for example a bridge portion similar to 18*a*. In the TPA set position of FIG. 5, the sidewalls of CTPA member 14 overlie terminal latches 10*c* on connector housing 10, thereby providing terminal position assurance by the visually verifiable position of the CTPA member, and further by preventing the withdrawal of the fully inserted terminal against the one-way camming features of the terminal latches 10*c* locked down by the CTPA sidewalls.

The TPA set position of FIG. 5 is also the CPA preset position, meaning that the TPA-assured connector/terminal combination 10, 12 is ready for connection to mating connector 20 and its previously installed terminal 22. FIG. 6 shows connector 20 inserted partway into connector 10 (hereafter the connector housings and their terminals will be referred to simply as "connector" wherever possible). A portion 20*a* of connector 20 which functions as a CPA latchmate is designed to lockingly engage latch arm 18 on the first connector, and additionally and simultaneously to displace CTPA lock arm 14*c* from the TPA set/CPA preset position in slot portion 18*b*. Before doing so, however, cantilever latch arm 18 and CTPA lock arm 14*c* are flexed upwardly as a unit when front cam face 20*b* of latchmate 20*a* engages latch arm forward end 18*a,* as best shown in FIG. 6.

Figure 7:
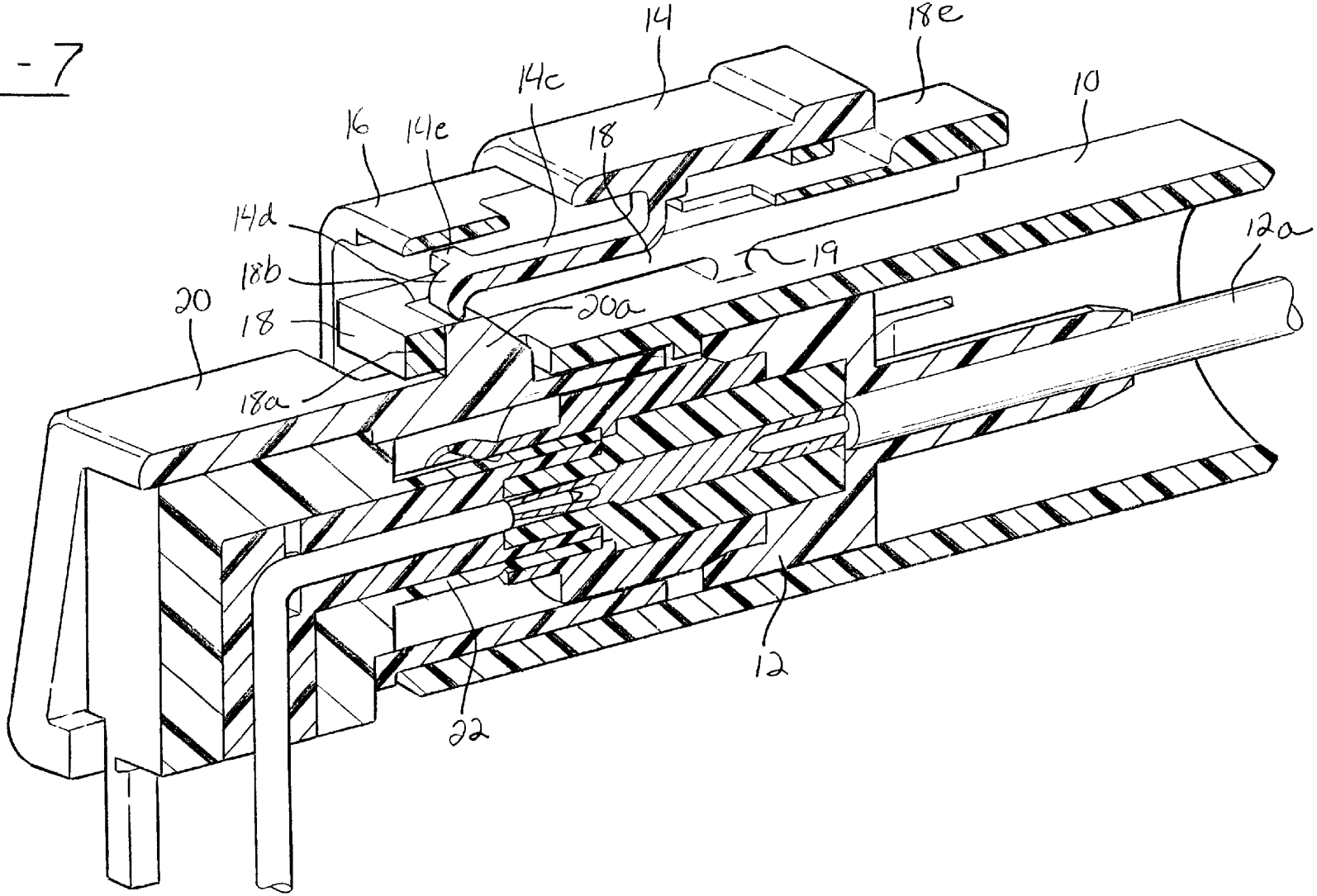
FIG. 7 is a cutaway perspective view similar to FIG. 6, but with the mating connector and terminal fully mated with the first connector and terminal, and the CTPA member released from the CPA preset position.

Referring to FIG. 7, when projection 20*a* reaches slot portion 18*b* from the underside of latch arm 18, it pops into slot portion 18*b* and hook 14*d* is forced up out of slot portion 18*b,* lifting lock arm ears 14*e* so that the CTPA member can be moved rearwardly over the transition ears 18*c*. FIG. 7 shows latch arm 18 having relaxed to its rest position, dropping away from the still flexed CTPA lock arm 14 to allow lock arm 14 to be pulled over transition ears 18*c*.

Figure 8:
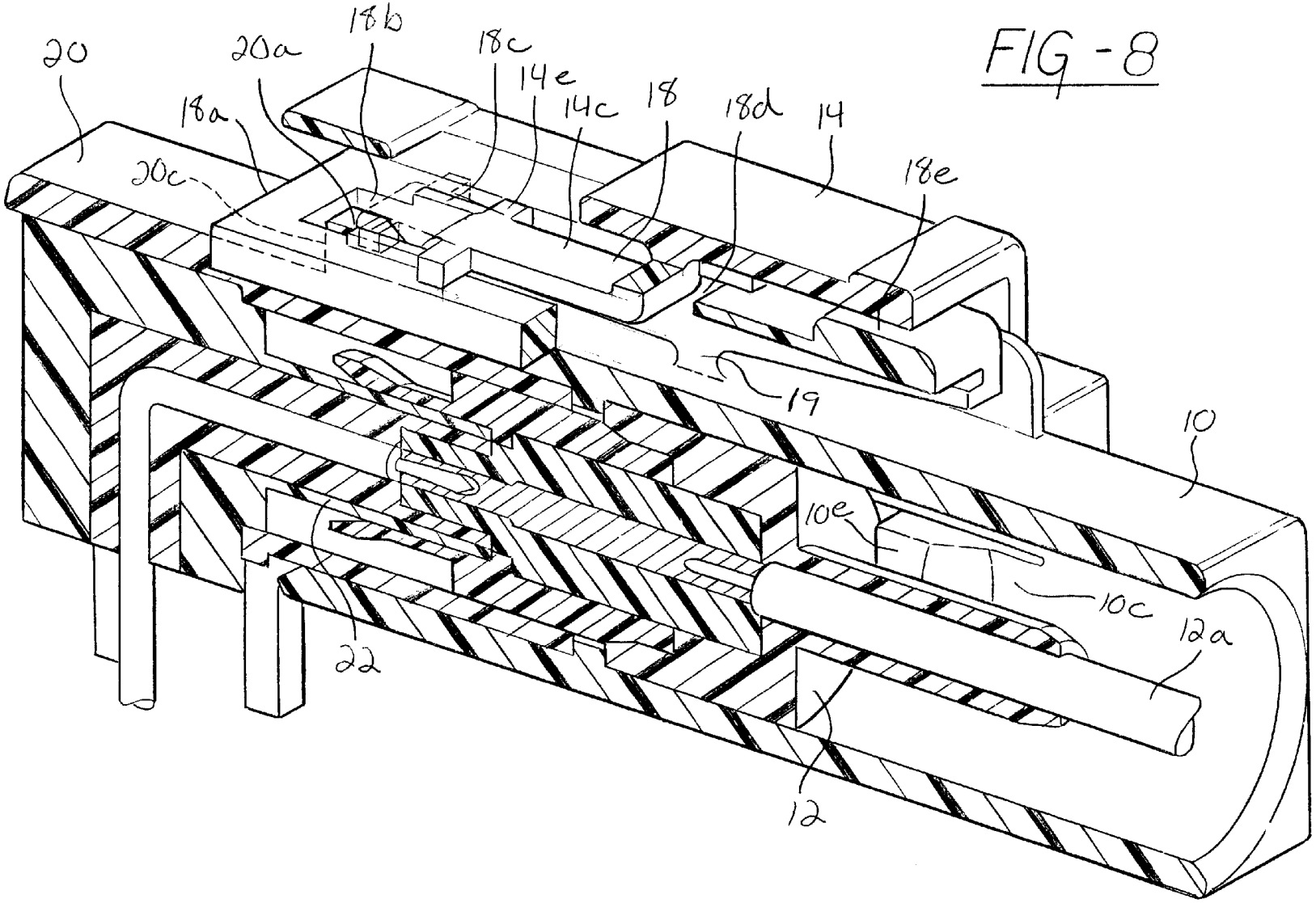
FIG. 8 is a cutaway perspective view similar to FIG. 7, but from the right side, showing the CTPA member in transition between the CPA preset and CPA set positions (phantom lines) and locked into the CPA set position (solid lines).

FIG. 8 shows the transition of lock arm 14*c* over ears 18*c* (phantom lines) to its final, CPA set position (solid lines), in which hook 14*d* has dropped into the CPA set slot portion 18*d* behind ears 18*c,* allowing lock arm 14*c* to relax and once again rest on the latch arm. This CPA set position is resistant to any unintentional release or decoupling of CTPA member 14, connector 20, or terminal 12, making for a solid connection.

CTPA member 14 is prevented from shifting forward by the interference between ears 14*e* on the lock arm and transition ears 18*c* on the latch arm. The flexible, cantilever nature of lock arm 14*c* gives it a bias to remain flat against latch arm 18, and the abutting portions of lock arm 14*c* and latch arm transition ears 18*c* can be configured to require varying degrees of forward-directed sliding force to overcome their interference and allow the lock arm to be raised clear to shift the CTPA forward. Alternately, their abutting portions can be configured to prevent any amount of forward-directed sliding force from overcoming their slide-blocking engagement, such that only the direct lifting of the lock arm 14*c* (for example with a tool) will enable the CTPA member to be shifted forward.

CPA latchmate 20*a* in slot portion 18*b* of latch arm 18 prevents withdrawal of connector 20 from connector 10. In the illustrated embodiment the rear face 20*c* of latchmate 20*a* is essentially flat and abuts the essentially flat face of the rear-facing side of latch arm front end 18*a,* preventing virtually any amount of longitudinal withdrawal force from pulling connector 20 free. In the event that disconnection is desired, however, latch arm 18 includes a connector release tab 18*e* on its cantilevered rear end, operable manually by depressing it to flexibly raise front end 18*a* and slot portion 18*b* out of engagement with CPA latchmate 20*a* on connector 20. CTPA member 14 prevents unintended operation of release tab 18*e* by substantially or entirely overlying the tab, such that an intentional effort must be made (usually with a tool) to depress the tab underneath the protective cover of CTPA member 14.

As long as CTPA member 14 remains in the CPA set position overlying the terminal latches on the sidewalls of connector 10, terminal 12 is positively prevented from being withdrawn. The piggyback, opposed cantilever relationship of CTPA lock arm 14 on latch arm 18 also ensures that the act of releasing connector 20 via release tab 18*e* does not unlock the CTPA member from the CPA set position.

Figure 9:
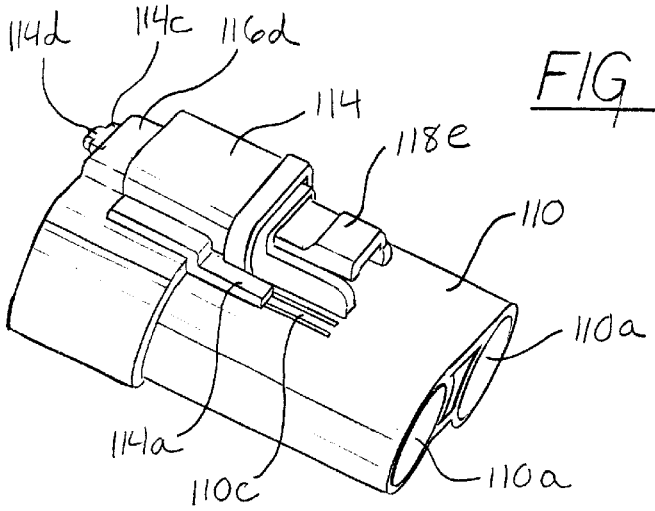
FIG. 9 is a perspective view of an alternate first connector housing and CTPA structure similar to that of FIGS. 1 through 8, but for a multiple terminal connection, with the CTPA member in the TPA preset position prior to terminal insertion.
Figure 10:
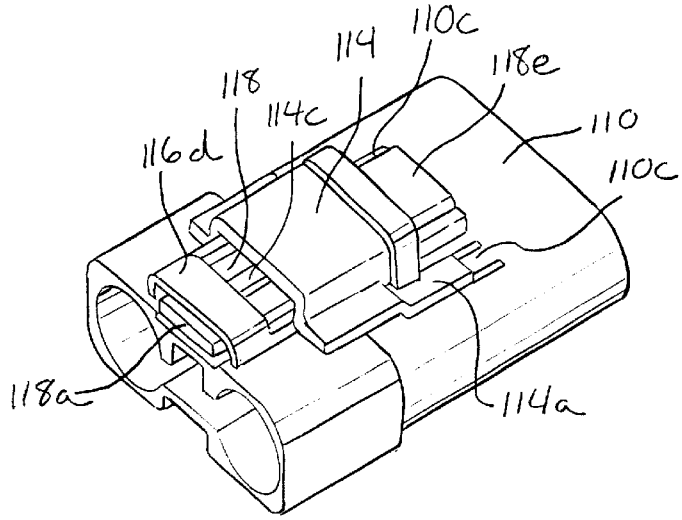
FIG. 10 is a perspective view of the first connector and CTPA member of FIG. 9 in the TPA set/CPA preset condition, after the terminal has been fully inserted and the CTPA member has been moved to lock the terminal in place.
Figure 11:
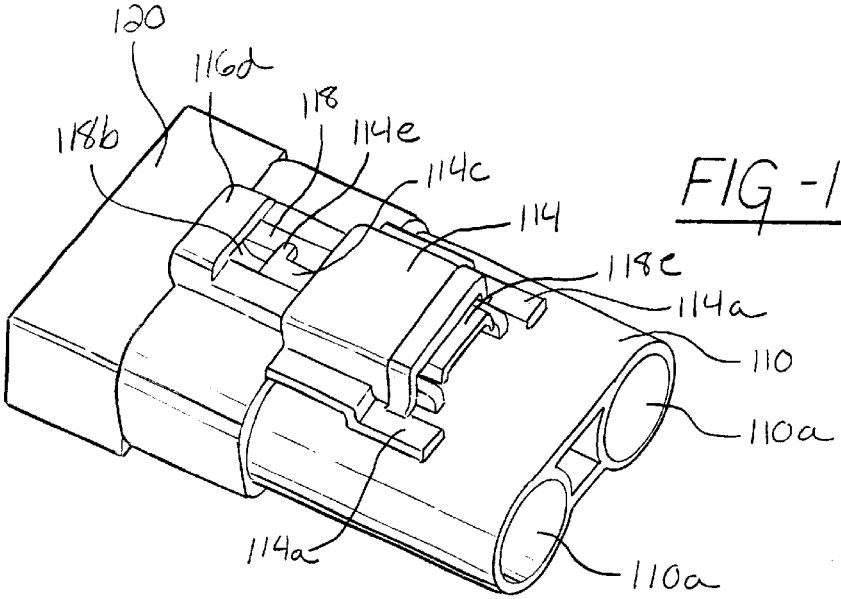
FIG. 11 is a perspective view of the connector and CTPA member of FIG. 9, but with the mating multiple terminal connector fully mated with the first connector and the CTPA member in the final, locked, CPA set condition.

Referring next to FIGS. 9 through 11, the invention is illustrated for a multiple-terminal connector, the primary difference being in the location of the terminal latches 110*c* on an upper surface of multiple terminal connector housing 110, and a different configuration of the CTPA member sidewalls to overlie the new terminal latches. The structure and operation of the locking and latching structures through TPA preset, TPA set/CPA preset, and CPA set positions is essentially the same as in FIGS. 1 through 8, and corresponding structure is similarly numbered after the 1_prefix.

FIG. 9 illustrates the CTPA member 114 in the TPA preset position on connector 110, with CTPA sidewalls 114*a* forward of terminal latches 110*c*. Structure 116 is essentially the same as structure 16 in FIGS. 1 through 8, supporting CTPA member 114 in sliding fashion on connector housing 110 with its lock arm 114*c* in operative connection with latch arm structure 118. Lock arm 114*c* and latch arm 118 are also essentially the same as their corresponding lock arm and latch arm structures 14*c* and 18 in FIGS. 1 through 8. Hook portion 114*d* of lock arm 114*c* in FIG. 9 engages latch arm forward end 118*a* to hold CTPA member 114 in the TPA preset position until terminals (not shown) have been fully inserted in their receptacles 110*a* (FIG. 10). After being briefly displaced outwardly during the insertion of the terminals, latches 110*c* return to their rest position flush with the outer wall of connector housing 10. CTPA member 114 can then be moved rearwardly over latches 110*c* to the TPA set/CPA preset position shown in FIG. 10 by disengaging hook end 114*d* of lock arm 114*c* from latch arm end 118*a*.

FIG. 11 shows CTPA member 114 in the rearwardmost CPA set position after a mating multi-terminal connector 120, similar to connector 20 in FIGS. 1 through 8, has been fully mated with connector 110 in a manner displacing lock arm 114*c* from its TPA set/CPA preset engagement with latch arm 118. In the final CPA set position of FIG. 11, CTPA member 114 protects latch arm manual release tab 118*e* from being unintentionally depressed.

It will be understood that the foregoing examples of illustrative embodiments of the invention are not intended to limit the scope of the invention beyond the following claims, since the inventive CTPA member and its associated latch structure can be formed on virtually any known connector in a connector set requiring or benefiting from CPA and TPA functions as known in the vehicle wiring system art. The CTPA and latch structure may take different forms as applied to such different connectors without departing from the invention, as dictated by ordinary design and environmental considerations known to those skilled in this field. In short, the TPA preset, TPA set/CPA preset, and CPA set conditions achieved by the interaction of the CTPA member, the terminal latches, the first connector latch arm structure, and the mating connector shown above by way of example can also be achieved with structure modified from that shown, now that I have disclosed it.

I accordingly claim:

1. In combination with a first connector housing of a vehicle wiring system type connector set in which the first connector housing is adapted to have a first terminal installed therein to form a first connector, and thereafter the first connector is ready at a forward end thereof to be mated with a second connector, a CTPA (connector/terminal position assurance) structure for providing both TPA (terminal position assurance) and CPA (connector position assurance) functions, comprising:

a connector latch on the first housing having a forward end located so as to latch a latchmate portion of the second connector when the second connector is mated with the forward end of the first connector, the connector latch defining TPA preset, TPA set/CPA preset, and CPA set positions, respectively, from the forward end of the connector latch toward a rear end thereof;

a CTPA member slidably mounted on the first connector housing and operatively connected to the connector latch, the CTPA member having a lock portion designed to lockingly engage the connector latch in the TPA preset, TPA set/CPA preset, and CPA set positions so as to resist forward or rearward motion, the CTPA member slidable on the first connector housing rearwardly from the TPA preset to the TPA set/CPA preset position after the first terminal has been fully installed in the first connector housing, the CTPA member slidable more rearwardly from the TPA set/CPA preset position to the CPA set position after the mating connector has been mated with the first connector; and, a terminal latching member on the first connector housing, the terminal latching member being responsive to an improper installation of the first terminal to block the CTPA member from moving from the TPA preset to the TPA set/CPA preset position, the terminal latching member in turn being blocked from releasing the first terminal from the first connector housing when the CTPA member is in the TPA set/CPA preset and CPA set positions.

2. The combined CTPA member and first connector housing of claim 1, wherein the connector latch on the first connector housing is a flexible, forward-facing, cantilevered member whose forward end is adapted to be engaged by the mating connector when the mating connector is mated with the first connector.

3. The combined CTPA member and first connector housing of claim 2, wherein the lock portion of the CTPA member is released from its locking engagement with the connector latch in the TPA set/CPA preset position by the latchmate portion of the mating connector when the mating connector is mated with the first connector.

4. The combined CTPA member and first connector housing of claim 3, wherein the lock portion of the CTPA member is a flexible, forward-facing, cantilevered lock arm riding in opposed, piggyback fashion on the connector latch.

5. The combined CTPA member and first connector housing of claim 4, wherein the CTPA member lock arm is flexibly biased against the connector latch.

6. The combined CTPA member and first connector housing of claim 4, wherein the connector latch includes a rear cantilevered release portion which when depressed in the CPA set position raises the forward end of the connector latch sufficiently to release the latchmate portion of the mating connector, the CTPA lock arm in the CPA set position flexing as a unit with the connector latch so as to remain lockingly engaged with the connector latch in the CPA set position.

7. A TPA (terminal position assurance) and CPA (connector position assurance) combination structure for a first connector half of a vehicle wiring system connector set, comprising:

a connector latch on the first connector half adapted to latch a mating connector half;

a terminal latching member on the first connector half adapted to latch a terminal inserted into the first connector half;

a CTPA (connector/terminal position assurance) member movable on the first connector half between a forward TPA preset position in which the terminal may be freely inserted and in which the CTPA member is blocked by the terminal latching member if the terminal is improperly inserted, an intermediate TPA set/CPA preset position in which the CTPA member prevents the terminal latching member from releasing an inserted terminal and from which the CTPA member is blocked from moving by the connector latch until the mating connector half is mated with the first connector half, and a rearward CPA set position in which the mating connector half is blocked from being unmated from the first connector half by the connector latch until the connector latch is released and in which the CTPA member guards the connector latch from accidental release.

8. The TPA and CPA combination structure of claim 7, wherein the position of the CTPA member relative to the first connector half provides an external indication of the TPA preset, TPA set/CPA preset, and CPA set positions.

* * * * *